United States Patent [19]

Helle

[11] Patent Number: 4,670,200

[45] Date of Patent: Jun. 2, 1987

[54] PROCESS FOR THE PRODUCTION OF PROPELLANT POWDERS

[76] Inventor: Charles Helle, Rua José Gustavo Macedo Soares Busch 1221, Morumbi, Sao Paulo, Brazil

[21] Appl. No.: 784,019

[22] Filed: Oct. 4, 1985

[30] Foreign Application Priority Data

Oct. 4, 1984 [BR] Brazil ..... PI 8405016

[51] Int. Cl.[4] ..... C06B 21/00

[52] U.S. Cl. ..... 264/3.3; 264/3.4; 264/3.6

[58] Field of Search ..... 264/3.1–3.6

[56] References Cited

U.S. PATENT DOCUMENTS

| | | | |
|---|---|---|---|
| 3,622,655 | 11/1971 | Bonyata et al. | 264/3.5 |
| 3,671,515 | 6/1972 | Cox et al. | 264/3.5 X |
| 4,014,655 | 3/1977 | Brunnberg | 264/3.3 X |
| 4,120,920 | 10/1978 | Cougoul et al. | 264/3.3 |
| 4,126,497 | 11/1978 | Johnson et al. | 264/3.3 X |
| 4,298,552 | 11/1981 | Gimler | 264/3.3 |
| 4,444,606 | 4/1984 | Bertrand et al. | 264/3.4 X |

*Primary Examiner*—Peter A. Nelson

*Attorney, Agent, or Firm*—Beveridge, DeGrandi & Weilacher

[57] ABSTRACT

There is described a process for the continuous or semi-continuous fabrication of propellant powders for the production of a powder having reproducable characteristics, in extremely safe conditions, thus overcoming the disadvantages found in the existing batch processes. In accordance with the invention, raw nitrocellulose is homogenised and stored under water in large tanks, from which it is fed in a controlled manner to a continuous centrifuge which removes water and alcoholises the nitrocellulose gradually. The alcoholised nitrocellulose is fed continuously to a stage where it is mixed with solvents and additives to form a gel which is compacted and extruded into filaments. Granules are made from the filaments and are transported in small batches to a preliminary drying step which removes that larger part of the solvents, in suitable vessels in a programmed manner. The granules discharged from these vessels are collected, in an inert state, and thereafter the powder is prepared and transported hydraulically to subsequent stages, including boiling and final drying.

12 Claims, 2 Drawing Figures

PROCESS FOR THE PRODUCTION OF PROPELLANT POWDERS

Figure 1:
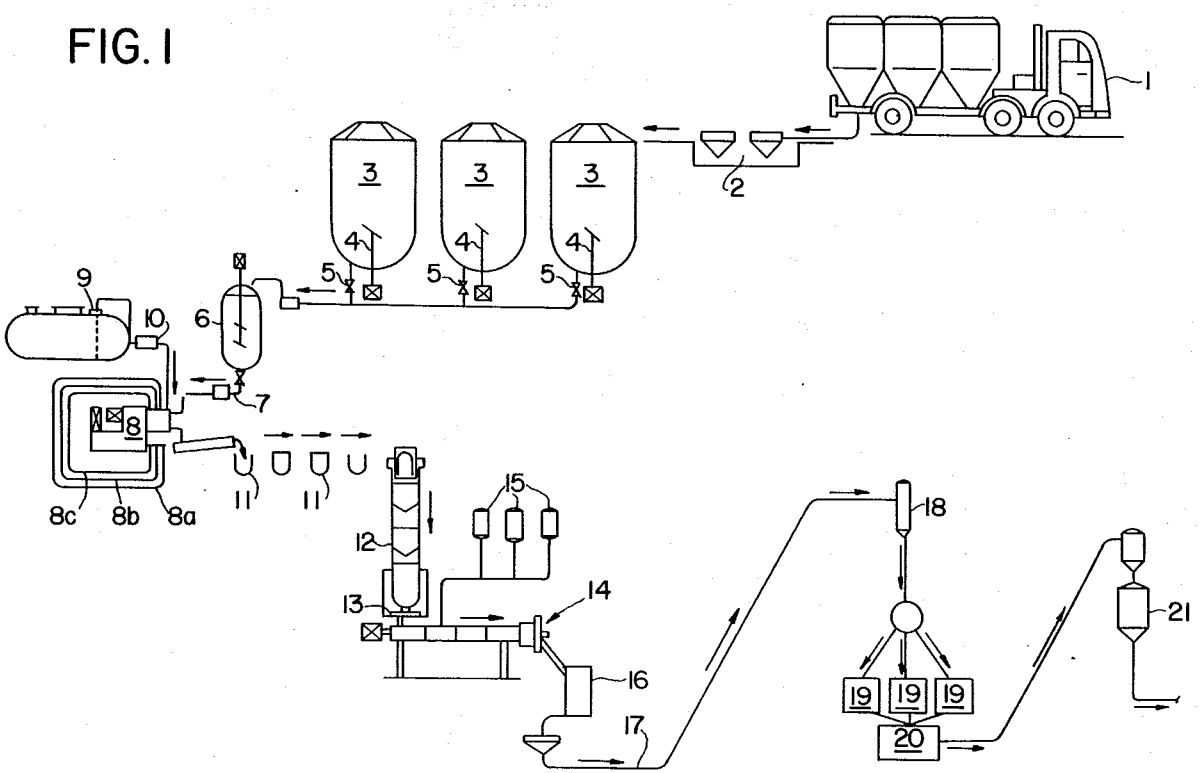

Organic nitrates and nitrates in general are the basic components of propellants. In traditional or classic processes for the production of propellant powders, based, for example, on the processes of Nobel, Du Pont and others, the principal component of the material is nitrocellulose.

These traditional processes have been used by manufacturers of gunpowder worldwide for many years, but hitherto no viable continuous or semi-continuous process for the production of gunpowder on an industrial scale has been developed.

Typically, the processes used contain a large number of isolated steps, and there follows a brief description of the current industrial process in broad terms.

Nitrocellulose is received from the supplier, for safety reasons, in a moisened state containing generally not less than 30% water. In this state, nitrocellulose is effectively inert. Dry nitrocellulose may become a highly dangerous explosive.

To maintain its humidity, nitrocellulose is packed in waterproof bags, drums or other hermetically sealable containers for transport and storage. The quantitiy of nitrocellulose in each container is limited by safety and handling considerations to between 20 and 80 kg, depending on the manufacturer's capabilities. Nitrocellulose is stored in the factory in quantities sufficient to ensure an uninterrupted production run, and tens of tons may be necessary, even for modest production quantities.

The drums are discharged from the transporting vehicle and are piled in the store room, samples being taken from various drums for quality control. Very often there are great differences between the samples taken from different drums.

The nitrocellulose is then transported for drying and alcoholising, this being a batch operation. In this operation the water is displaced and substituted with alcohol, generally in hydraulic presses or in centrifuges. The quantity of nitrocellulose processed at each batch varies between 50 and 250 Kg in accordance with the equipment used. The weighing or measurement of the nitocellulose is not very exact, and the alcohol is added separately to each batch.

The alcoholised nitrocellulose is once again packed in hermetically sealed drums, which are transported and stockpiled in further stores. Samples are again taken for quality control, and there is almost always a difference between the content of different drums.

Thereafter, the nitrocellulose is transported to a gelatiniser, where 150 to 500 kg of nitrocellulose, i.e. the contents of various drums, is mixed with further solvents and other additives, for example, stabilisers, plasticisers, flame retardants or the like. The additives are weighed separately for each operation. After processing for from 1 to 4 hours, the material is removed and packed in further containers, also hermetically sealed.

The containers are then taken for compaction of the material in hydraulic presses. The product is a billet whose diameter depends upon the extrusion press. The weight of each billet may vary between 30 and 50 kg, in accordance with the press. These billets are collected in further containers, again hermetically sealed.

The containers of billets are then taken for extrusion.

Extrusion is performed in a hydraulic press. Generally the billets are extruded into filaments of various diameters, having one or more bores, or in strips in accordance with the desired propellant. The extrusion pressure varies from 150 to 300 bar, in accordance with the type of filament extruded.

The filaments or strips are placed in containers for superficial drying. In this operation the filaments acquire a consistancy which permits granulation.

Granulation may be performed in any of various types of machines. The granules are sifted and collected in a further container, and are transported for preliminary drying.

In this operation the granules are spread on trays, a total of 900 to 1500 kg per dryer. A large part of the solvent is evaporated under vacuum, taking from 18 to 48 hours. During the larger part of the drying process, explosive gases are produced from mixtures of air and solvent vapours.

The granules are again collected in containers, and are transported for intermediate graphiting, and thence to surface treatment.

This operation is generally performed in rotating drums, or pelleting machines, or other similar equipment. The granules are treated with ballastic moderators for final adjustment of the ballastic characteristics of the material.

After the superficial treatment the granules are collected in jute sacks. These are transported to large tanks, in which they are piled. In these tanks, the sacks of granules are treated with hot water (60° to 90° C.) to eliminate the last traces of solvent. This treatment may take from 1 to 8 days. The sacks of granules are then taken for final drying, and thereafter polishing, graphiting, sifting, homogenising and packing.

The common feature in all traditional processes is the remarkable quantity and variety of containers used in the factory for transporting raw materials and intermediate products. This transportation is a veritable subindustry, and consumes more labour than the actual production of the propellants.

Further, the processes present the following grave deficiencies:

(1) The weighing and measuring of the raw materials, additives and the like is repeated many times during each working shift, and introduces many sources of error which may propagate along the production line.

(2) The principal raw material, nitocellulose, is removed from small drums, and the homogeniety of the batch normally leaves much to be desired.

(3) The mixing of nitrocellulose, solvents and additives is performed in large quantities in sigma type mixers or gelatinisers, and the mixture is never perfect, the product never being homogeniously gelatinised. The mixture contains hard nodules.

(4) The compaction of the material in hydraulic presses also leaves much to be desired.

(5) In the extrusion of the material in hydraulic presses the rheology of the material is never constant. In addition, the filters need to be changed after each extrusion since they become clogged with the nodules in the material.

For these reasons the fabrication of propellants of homongenious quality is extremely difficult, and the reproduction of the same qualities depends on the experience and the skill of the operators and even then a large element of chance remains.

As well as the limitations on quality, the safety hazards are not negligible, due to the innumerable transports and handling operations on generally dangerous products. The large quantity of intermediate products present at the various phases of the process, in stores, in machines and equipment, and particularly in the dryers, are additional safety hazards. The high pressures used in extrusion, and the explosive gases formed in the dryers also expose the workforce of the factory to considerable risk. These dangers are recognized, as "calculated risks".

The present invention has as an objective the elimination of the majority, if not all, of the deficiencies listed above in relation to the known processes, and further introduction of several improvements.

In accordance with the present invention, a process for the preparation of propellant powders comprises the stages of:

(a) storing homogenised nitrocellulose free from foreign bodies, under water, in storage tanks or silos;

(b) feeding in a controlled and continuous manner the said nitrocellulose in aqueous suspension to a continuous centrifuge where the water is removed and the nitrocellulose is gradually and continually alcoholised;

(c) continually feeding the alcoholised nitrocellulose to a stage where the nitrocellulose is mixed with solvents and additives to form a gel which is compacted and extruded in the form of filaments, which are then cut to form granules;

(d) the intermittent transport of small quantities of granules to a preliminary drying stage;

(e) the preliminary drying of the granules to eliminate the larger part of the solvents, in suitable vessels in a programmed manner;

(f) Intermittent discharge of the vessels, by means of a device in which the granules are collected in an inert state;

(g) the hydraulic transport of the powder thus prepared to subsequent stages, including boiling and final drying.

The continuous or semi-continuous process, as will become evident, permits the utilisation of modern techniques of control and inspection, thus improving the quality, uniformity, and reproduceability of the final product, eliminating the larger part of the safety risks, and avoiding the presence of workers in areas where high risks may exist.

Figure 2:
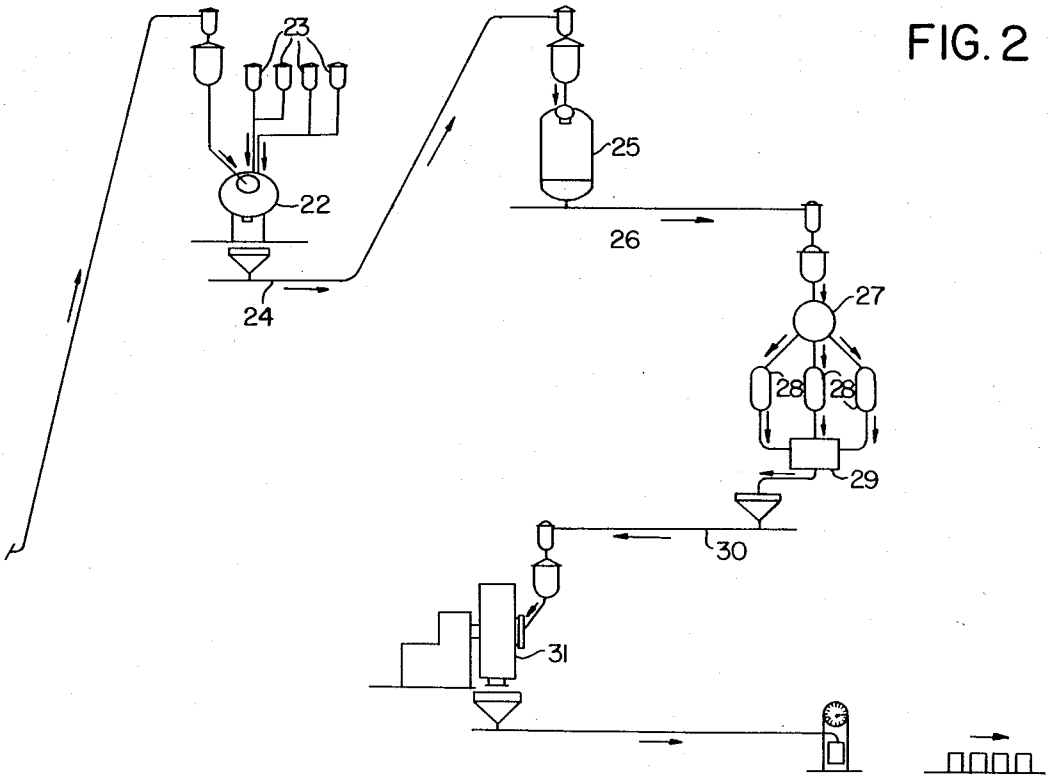

In order to permit a better comprehension of the present invention, there will be described an example of a production line for propellant powders according to the invention, reference being made to FIGS. 1 and 2 of the accompanying drawings which together comprise flow diagram illustrative of the process.

Refering to the drawings, nitrocellulose received from the factory in tank wagons (1) in quantities, for example, of at least 10 tons, and is transferred from the tank wagon (1) in aqueous suspension via a separator (2) which eliminates foreign bodies and impurities, to storage silos (3) with capacities of, for example, 120 $m^3$. In these silos the nitrocellulose may be homogenised by vigorous agitation, for example, by means of agitators (4). The nitrocellulose is stored under water, in a proportion of approximately 1:10. When necessary, nitrocellulose of low or high nitration may be supplied separately and mixed in the desired proportions in silos (3). The aqueous suspension is transferred via valves (5) from one or other of the silos (3), and is fed to a mixing vessel (6) where the required concentration is achieved. Thus, the homogenisation and concentration of the mixtures desired may be reproduced exactly at any time.

The aqueous suspension of nitrocellulose pulp from the mixing vessel (6) is delivered at a controlled flow rate via a meter (7) and is then fed continuously to a centrifuge (8). At a first stage, the centrifuge (8) eliminates the larger part of the water, and in subsequent stages gradually alcoholises the nitrocellulose by counter current. To achieve this, the alcohol stored in a tank (9) is fed via a second meter (10) to the last stage of the centrifuge, the diluted alcohol leaving this stage being circulated via the line 8*a* to the penultimate stage, and thence in a more diluted state, via line 8*b* to the previous stage, and thereafter via line 8*c* to the first alcoholising stage. The first alcoholising stage is directly after the initial dehydrating stage. The nitrocellulose leaves the centrifuge (8) with the required content of alcohol. The injection and recirculation of alcohol is rigorously controlled, as are all the other parameters which influence the quality of the drying and alcoholising. To list some examples, these are; the centrifugal force applied, the thickness of the layer of nitrocellulose, the dwell time of the nitrocellulose in the centrifuge basket, and the concentrations of alcohol in the recycling steps. Within the continuous centrifuge, there is never more than a few kilos of nitrocellulose. Safety devices will trigger alarms, stop the operation and feeding, and operate counter measures automatically in accordance with any emergency situation which might arise, or in the face of any maladjustment which might alter the quality of the product.

From the centrifuge (8) the alcoholised nitrocellulose is transferred to feeders (11) each containing, for example, 5 to 8 kg of nitrocellulose. The process is continuous, and therefore any possible fire is limited to the 5 to 8 kg of alcoholised nitrocellulose present in each feeder.

These quantities of nitrocellulose are then emptied into a receptacle (12) which is coupled to an electronically controlled metering weigher (13), and continuously fed to a continuous multi-function processing unit (14). The processing unit comprises two screws rotating in the same direction within the housing. The spaces between the screw elements and the internal walls of the housing are small, measurable in fractions of a millimeter. The screw elements are mounted in a combination which permits the processing unit (14) to execute its three or four principal functions, replacing various apparatus used in conventional processes, and achieving a perfection never previously obtained. These functions are:

(1) the mixing of the nitrocellulose with one or more solvents or additives, delivered from containers (15). The additives may be, for example, stabilisers, plasticisers, flame retardants, or the like. The addition of these ingredients is programmed and the flow rates are rigorously controlled and synchronised with the feeding of the nitrocellulose;

(2) the grinding, shearing and cutting of the mass of nitrocellulose, solvents and additives, until any remaining nodules or other lumps are completely eliminated. The mass is compacted, and at the same time some or all thereof is transformed into a gel;

(3) the extrusion of the mass, which may be through filters or other such devices when necessary for the material to pass through extrusion dies, or the direct extrusion of the mass through an extrusion die since no nodules, lumps or impurities will be present;

(4) the cutting of the extruded filaments at the die face, should this mode of granulation be adopted.

The temperature of the material during this processing is programmed and maintained at each step within the limits which are considered adequate.

The pure and homogenous mass is maintained in constant motion, and its rheology will be uniform. The extruded filaments are more compact and resistant, and have greater density than those formed in the conventional process. At the same time, the outlet pressure may be only 50 or 100 bar.

This has hitherto not been achieved with hydraulic presses.

As may be seen, the processing unit (14) replaces the gelatiniser, the billet press, and the extrusion press of the conventional process. Even so, there are never more than a few kg of material present in the processing unit (14).

The extruded filaments are sufficiently firm that the preliminary drying operation may be almost always eliminated. The granulation may either take place on the extrusion die face, or in a separate granulator. In any event, due to the consistency of the filaments, the granulation is normally such that preliminary sifting is unnecessary.

The granules may be graphited in a graphiting device (16) and transferred by a pneumatic system (17) in small quantities, without the necessity of manual intervention, to the following operation, a preliminary dryer (18).

The granules thus transferred are fed, batch by batch, to one of the various vessels (19) of the preliminary dryer (18), until the desired quantity has accumulated in each vessel, in various layers.

During the drying, at programmed temperatures, the solvents are gradually eliminated from the granules. The temperature and speed of drying may be adjusted with precision. At no time during the drying does the formation of explosive gasses occur. At the end of the drying step, the granules are transferred to a collector (20), in which they are stored in an inert state. All of the steps of this operation are automatically programmed and controlled, without manual intervention.

From the collector (20), when necessary, the granules are ejected using a water jet to a meter (21), which measures a precise quantity of granules. From the meter (21) the granules are passed to the following operation, which may be surface treatment, or boiling, depending on the final product desired.

In the surface treatment step, a pelleting machine (22) receives an exact quantity of granules from the meter (21). The pelleter (22) may be heated or cooled, and is maintained at the predetermined temperature, before during and after the addition of the ballistic moderators or other ingredients, from feeders (23). The incorporation of additives such as ballistic moderators obeys rigorously a predetermined quantity-time-temperature relation.

The powder is transferred using a jet of water by means of a hydraulic system (24) to a boiler (25), once again without manual intervention, the transport system forming part of the operation.

In this operation, the powder is boiled in water under vacuum, at a temperature sufficiently low so as not to prejudice the stability of the nitrocellulose. The solvent residues are reduced to a predetermined percentage, in approximately eight hours.

From the boiler (25) the powder is transferred using a hydraulic device (26) to the feeder of a final dryer (27).

For safety reasons, the drying vessels (28) of the dryer (27) are dimensioned so as to receive small quantities such as, for example, from 5 to 20 kg. The temperature and speed of drying may be precisely adjusted, and the drying cycle usually takes less than one hour at a temperature not exceeding 70° C. When the drying cycle is completed the powder is delivered to a preliminary graphiter (29). It is an important aspect of the construction of the drying vessels (28) that the column of dry powder does not exceed the critical height for an explosion.

After preliminary graphiting the powder is transferred by means of a pneumatic system (30), batch by batch, to the polishing and final graphiting step (31). The calculated risk is limited to the quantity of each batch, i.e. the content of one drying vessel (28) (5 to 20 kg). Since the transfer is automatic, the work force is not exposed to risk.

Homogenisation of large quantities of finished powder does not form part of the normal production routine, and will only be necessary in isolated cases to meet more rigorous specifications.

It will be understood that the production line described above with reference to the drawings represents only one way of putting the present invention into practice, and there exist many possibilities for modifying the practical execution of this novel inventive concept. From the description above, however, the basic and important characteristics of the process will be easily understood, and its great value in the production of propellant powders will be appreciated.

The new process also either has or permits the achievement of the following advantages:

Safety.

The process is continuous or semi-continuous, and eliminates the presence of personnel in the areas of greater risk. Even so, the process operates in such a manner that the existing risks in these areas are minimised. The storage of raw material in storage silos, under water, eliminates all risk from the initial phase of the process, since in this state nitrocellulose is totally inert.

The removal of water and alcoholisation in the centrifuge is such that only a few kilogramms of material are in the centrifuge at any one time, limiting the risk to this small quantity of material. In conventional drying and alcoholising processes, batches of 50 to 250 kg are common, and evidently the risk is greater.

Although the handling of alcoholised nitrocellulose does not represent a great risk since the product is in a relatively insensitive state, in the process of invention its transport to the next stage is performed preferably in individual feeders (11), each containing only 5 to 8 kg.

The incorporation of additives, compaction, extrusion and cutting are performed in the processing unit (14), which also processes a small quantity of material at any given moment, and has a low outlet pressure of, for example, 50 to 100 bars. This represents a minimum fire or explosion risk, and should be compared with the various steps involved in the conventional-process, which includes packing in hermetically sealed drums, manual sampling, transport in batches of 50 to 500 kg for gelatinising treatment lasting 2 to 4 hours, a further packing in closed containers, a further transport to the billeting presses, and final extrusion using pressures of from 150 to 300 bars, followed by surface drying, cutting or granulation. At this point in the present process, the granules are removed to the preliminary dryer in small batches for safety reasons, by means of a pneumatic system (17).

In the preliminary dryer of the invention, a large part of the solvents is removed without the formation of explosive gases. Further, each drying vessel (19) of the preliminary dryer is relatively small and the powder is collected in an inert state. In comparison, the preliminary drying of the conventional process is performed on trays, over 48 hours, with quantities of up to 1500 kg being processed at each batch.

After preliminary drying and until final drying, the intermediate product is always transported in hydraulic systems, substantially eliminating any risk of explosion fire. In the conventional processes, the operation between preliminary drying and final drying involve packing in drums, and processing in relatively large batches.

In the final drying, in accordance with the present invention, each vessel is limited to from 5 to 20 kg of the product, the column of powder in each vessel never exceeding the critical height and the temperatures are always rigorously controlled to eliminate any possible risk.

After final drying, the (dangerous) dry powder is transferred to the predetermined final treatment in small separate batches.

Each transportation step involving material which has reached a dangerous state, i.e. after the formation of the granules, is performed by hydraulic or pneumatic systems with the material travelling in tubes. In the case of pneumatic transport systems, the diameters of the tubes are made less than the so-called critical diameter for the particular type of explosive, and the ratio of material to air (or gas) is rigorously maintained within safe limits. This is not possible in the conventional processes, where transportation is effected in drums or in jute sacks.

Finally, the continuous process of the invention facilitates the use of automatic safety devices operated by any excessive variation of a process parameter at any point on the production line.

Final Product Quality.

The use of large storage silos in the initial step of the process permits large quantities of raw material to be homogenised, which results automatically in a starting material having more uniform properties. In conventional processes, which use isolated quantities of starting materials, packed in drums, great variations are seen in the properties of the starting materials. The fact that the process is continuous automatically permits the use of modern techniques of control and inspection. It should be emphasised that this control and inspection does not itself form part of the invention. The main inventive concept is that the idealised process permits the use of such techniques, which has not been possible with existing batch processes.

The fact that the process is continuous or semicontinuous, with automatic control, is important in eliminating substantially all human error in the measurements of materials, and in the maintenance of process parameters within predetermined limits. Because of this, the ballistic properties of the final products are more uniform and reproducable. The use of automatic control systems permits corrective measures or even the stopping of production should any critical parameter exceed predetermined values at any point on the production line. In other words, the entire process may be automatically controlled with precision, and all the steps of the process are based on scientific methodology and are reproducable.

It should be further observed that the average duration of the operations of the process is reduced, and the quantities being processed at any given moment in any stage are small. This improves safety.

Another point which should be emphasised is the facility of adjusting the process in accordance with the final product desired. Thus, the sequence of operations is extremely flexible since both the hydraulic and pneumatic systems may transport intermediate products to any point on the production line. For example, by the simple operation of valves, the order of stages 23 and 26 may be inverted or any unnecessary stage in the production of a determined product may be eliminated.

I claim:

1. Process for the production of propellant powders comprising the steps of:

(a) storing homogenized nitrocellulose free of foreign bodies under water in storage tanks or silos;

(b) feeding said nitrocellulose in aqueous suspension in a controlled and continuous manner to continuous centrifuge, where the water is removed and the nitrocellulose is gradually and continuously alcoholized;

(c) continuously feeding the alcoholized nitrocellulose to a mixer and mixing the nitrocellulose with solvents and additives to form a gel;

(d) compacting and extruding the gel to form filaments;

(e) cutting the filaments to form granules;

(f) intermittently transporting small batches of the granules to a preliminary drying stage;

(g) preliminarily drying the granules to eliminate the larger part of the solvent in suitable vessels, in a controlled manner;

(h) intermittently discharging the vessels by means of a collector in which the granules are collected in an inert state; and (i) hydraulically transporting the powder thus prepared to subsequent stages, including boiling and final drying.

2. A process in accordance with claim 1 wherein the nitrocellulose is provided in tank wagons and is tranferred using water, via a filtering step in which foreign bodies are separated, to the said storage tanks or silos.

3. Process in accordance with claim 1 wherein the nitrocellulose is homogenized in the said tanks or silos by means of agitation.

4. Process in accordance with claim 1, 2 or 3 wherein the nitrocellulose is supplied in separate lots of high and low nitration, respectively, which are mixed as desired in the tanks or silos.

5. Process in accordance with claim 1, 2 or 3 wherein step (b) of feeding the nitrocellulose in aqueous suspension to the continuous centrifuge includes a mixing vessel where regulation of concentration of nitrocellulose in the suspension is performed.

6. Process in accordance with claim 1, 2 or 3 wherein the suspension of nitrocellulose is centrifuged in a first step to eliminate the larger part of the water, and in subsequent steps alcohol is added in contraflow in relation to the nitrocellulose.

7. Process in accordance with claim 1, 2 or 3 wherein the alcoholized nitrocellulose from the continuous centrifuge is fed to the mixing, compaction, extrusion and cutting in small separate batches.

8. Process in accordance with claim 7 wherein the alcoholized nitrocellulose is metered when being fed to the said mixing, compaction, extrusion and cutting.

9. Process in accordance with claim 1, 2 or 3 wherein the said mixing, compaction extrusion and cutting include a single apparatus of continuous operation to effect the mixing, compaction and extrusion, the said apparatus comprising a housing containing two screws which rotate in the same sense, spacing between screw elements and an internal wall of the housing being of the order of fractions of a millimeter.

10. A process in accordance with claim 1 wherein the step (g) of preliminary drying comprises the gradual removal of the solvents contained in layers of powder formed in each vessel, with the temperature and drying velocities controlled.

11. Process in accordance with claim 1 wherein after the final drying step, the powder is transported pneumatically in small batches to final stages, such as polishing, final graphiting and packing.

12. Process in accordance with claim 1 which includes a step of preliminary graphiting and packing.

* * * * *